US009077076B2

(12) United States Patent
Lee

(10) Patent No.: US 9,077,076 B2
(45) Date of Patent: Jul. 7, 2015

(54) COMPACT, ULTRA-BROADBAND ANTENNA WITH DOUGHNUT-LIKE RADIATION PATTERN

(71) Applicant: Keysight Technologies, Inc., Minneapolis, MN (US)

(72) Inventor: Gregory S. Lee, Mountain View, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 219 days.

(21) Appl. No.: 13/688,398

(22) Filed: Nov. 29, 2012

(65) Prior Publication Data

US 2013/0194160 A1 Aug. 1, 2013

Related U.S. Application Data

(60) Provisional application No. 61/592,979, filed on Jan. 31, 2012.

(51) Int. Cl.

| | |
|---|---|
| ***H01Q 13/00*** | (2006.01) |
| ***H01Q 1/00*** | (2006.01) |
| ***H01Q 1/36*** | (2006.01) |
| ***H01Q 9/28*** | (2006.01) |
| ***H01Q 9/40*** | (2006.01) |

(52) U.S. Cl.
CPC . *H01Q 1/36* (2013.01); *H01Q 9/28* (2013.01); *H01Q 9/40* (2013.01)

(58) Field of Classification Search
CPC . H01Q 13/0208; H01Q 13/04; H01Q 19/132; H01Q 1/36; H01Q 9/40; H01Q 9/28
See application file for complete search history.

(56) References Cited

U.S. PATENT DOCUMENTS

| | | | | |
|---|---|---|---|---|
| 2,175,252 | A * | 10/1939 | Carter | 343/773 |
| 2,511,849 | A * | 6/1950 | Hilferty et al. | 343/773 |
| 2,532,551 | A * | 12/1950 | Jarvis | 343/774 |
| 3,656,166 | A * | 4/1972 | Klopach et al. | 343/756 |
| 4,225,869 | A * | 9/1980 | Lohrmann | 343/773 |
| 4,947,181 | A * | 8/1990 | Duncan et al. | 343/773 |
| 6,667,721 | B1 * | 12/2003 | Simonds | 343/773 |
| 8,654,025 | B1 * | 2/2014 | Brock et al. | 343/752 |
| 2009/0058748 | A1 * | 3/2009 | Cohen | 343/773 |
| 2013/0050040 | A1 * | 2/2013 | Libonati et al. | 343/773 |

OTHER PUBLICATIONS

Transformation Security, LLC Model TS-2021, Dated 2009.
Schwarzbeck antenna Models RS 0460 and RS 16, Schwarzbeck Mess-Electronik.
Gibson, "The Vivaldi aerial", 1979 IEEE European Microwave Conference.

* cited by examiner

*Primary Examiner* — Trinh Dinh

(57) ABSTRACT

A compact, ultra-broadband antenna with doughnut-like radiation pattern is provided as including a first assembly having first and second ends; a second assembly having first and second ends, the first and second ends each configured to have a substantially hemispherical shape; and a cable configured to extend through the first and second assemblies and out each of the first and second ends.

19 Claims, 6 Drawing Sheets

COMPACT, ULTRA-BROADBAND ANTENNA WITH DOUGHNUT-LIKE RADIATION PATTERN

CROSS-REFERENCE TO RELATED APPLICATIONS

The present application claims priority under 35 U.S.C. §119(e) from U.S. Provisional Patent Application No. 61/592,979 entitled "Compact, Ultra-Broadband Antenna with Doughnut-Like Radiation Pattern" filed on Jan. 31, 2012 naming Gregory S. Lee as inventor. The entire disclosure of U.S. Provisional Patent Application No. 61/592,979 is specifically incorporated herein by reference.

BACKGROUND

Omni-directional antennas are widely used in communications for transportation, defense, security, mobile, and other applications. Omni-directional antennas are useful in situations where the direction of another communicating party is unknown, because it is indeterminate how to point the antenna in the specific direction of the other party. Conversely, in radio geolocation (range finding or radio location) where it may be desirable to pinpoint the location of an unknown emitter based on relative power measurements by plural system sensors, each sensor should have equal opportunity to measure the incoming power unskewed by antenna directionality.

In acoustics, 3D-omnidirectional transponders are well known. In contrast, due to the transverse polarization of electromagnetic waves, a true 3D-omnidirectional antenna is impossible. Hereinafter, omni-directional will refer to a simple "doughnut pattern", which is the characteristic far-field pattern of a small dipole which may be considered as up to a free-space wavelength $\lambda$. However, a dipole which is $1.5\lambda$ long has a far-field pattern that is azimuthally isotropic, but which exhibits three (3) elevation angle lobes. Adjacent lobes undergo a sign change, implying conical nodes. Unlike the zenith/nadir points of the dipole pattern which are point nodes, the nulls of the far-field pattern are line nodes and present a serious obstacle to 3D power-based geolocation, because an unknown emitter can easily lie in a nodal direction relative to the given sensor. In practice, these nulls can be at least 15-20 dB weaker than the high-gain directions of the antenna, even in an environment free of multipath.

Many broadband antennas exist and are commercially available. However, the commercial terminology "broadband" invariably refers to the impedance behavior of the antenna, or equivalently its return loss or voltage standing wave ratio (VSWR). Essentially, the far-field patterns of such broadband antennas evolve from simple (e.g., dipole-like) at low frequencies, to complicated (multi-lobed or highly directional) at high frequencies. This is especially true for the conventional discone antenna. Another well-known example is the biconical antenna, which has a relatively broadband doughnut-like pattern, but which yields a multi-lobed elevation angle pattern at high frequencies. Additionally, the biconical antenna has a large footprint which may present an excessive wind load outdoors and which may be difficult to construct in an inconspicuous manner for indoor use. Also, broadband biconical antennas may be expensive.

Therefore, there is a need for a compact, ultra-broadband antenna with a simple doughnut-like radiation pattern over a wide operating bandwidth. In particular, elevation angle pattern minima, other than those at the zenith and nadir, should be within 10 dB of the global pattern maximum. In addition, it is desirable that such an antenna be inherently inexpensive.

SUMMARY

In a representative embodiment, an antenna includes a first assembly having first and second ends; a second assembly having first and second ends, the first and second ends each configured to have a substantially hemispherical shape; and a cable configured to extend through the first and second assemblies and out each of the first and second ends.

BRIEF DESCRIPTION OF THE DRAWINGS

The illustrative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings.

Figure 1:
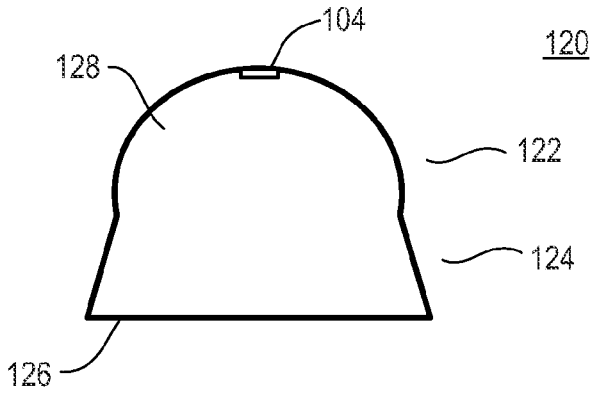
FIG. 1 is a schematic diagram illustrating an antenna assembly section, according to a representative embodiment.

FIG. 1 is a schematic diagram illustrating an antenna assembly section, according to a representative embodiment. Assembly section 120 shown in FIG. 1 may be characterized as generally helmet-shaped, configured as having an exterior surface 128 including a substantially hemispherical shaped geometry 122 on a truncated cone geometry 124. Assembly section 120 is hollow as including exterior surface 128 that is a conductive material such as copper for example, although any other conductive material such as aluminum may be used. Exterior surface 128 may have a thickness in a range of about 5 microns to 100 microns. Assembly section 120 may be formed by copper-plating on a plastic form (not shown) made of acrylonitrile butadiene styrene (ABS) for example. In a representative embodiment, assembly section 120 may also be formed by spinning copper. At the top end of assembly section 120, hole 104 is formed through exterior surface 128 of hemispherical shaped geometry 122, providing access to the hollow interior of assembly section 120. Hole 104 may have a diameter in a range of about 2 mm to 4 mm. Open end 126 of truncated cone geometry 124 may have a diameter in a range of about 5 cm to 10 cm.

Figure 2:
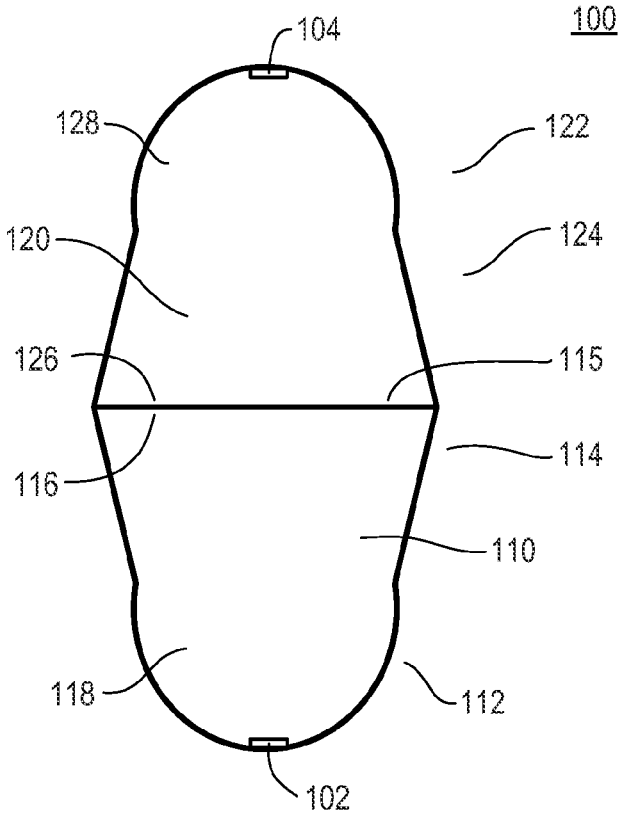
FIG. 2 is a schematic diagram illustrating an antenna assembly including a pair of assembly sections, according to a representative embodiment.

FIG. 2 is a schematic diagram illustrating an antenna assembly including a pair of assembly sections, according to a representative embodiment. Assembly 100 as shown in FIG. 2 is configured as having assembly section 120 as described with respect to FIG. 1, electrically connected to another assembly section 110 that is of similar construction as assembly section 120. Assembly section 110 may similarly be characterized as generally helmet-shaped, configured as having an exterior surface 118 including a substantially hemispherical shaped geometry 112 on a truncated cone geometry 114. Assembly section 110 is hollow as including exterior surface 118 that is a conductive material such as copper. At the bottom end of assembly section 110, hole 102 is formed through exterior surface 118 of hemispherical shaped geometry 112, providing access to the hollow interior of assembly section 110. Truncated cone geometry 114 further includes open end 116. Assembly section 110 and assembly section 120 may be soldered to each other at respective open ends 116 and 126 of the truncated cone geometries and electrically connected at seam 115, to provide a joint having a smooth surface without abrupt transition at seam 115. Seam 115 can either be a continuous gap-free solder ring, or a sequence of solder spots (tack soldering) placed every 15-45 degrees or so about the circumference. Assembly 100 may be characterized as having first and second ends through which holes 102 and 104 are disposed, the first and second, ends each configured to have a substantially hemispherical shape, and a mid-section between the first and second ends. In the representative embodiment of FIG. 3, assembly 100 may be characterized as having a mid-section between first and second ends that have substantially hemispherical shape. However, because of truncated cone geometries 114 and 124, a diameter of the mid-section near seam 115 is greater than a diameter at the first and second ends.

Figure 3:
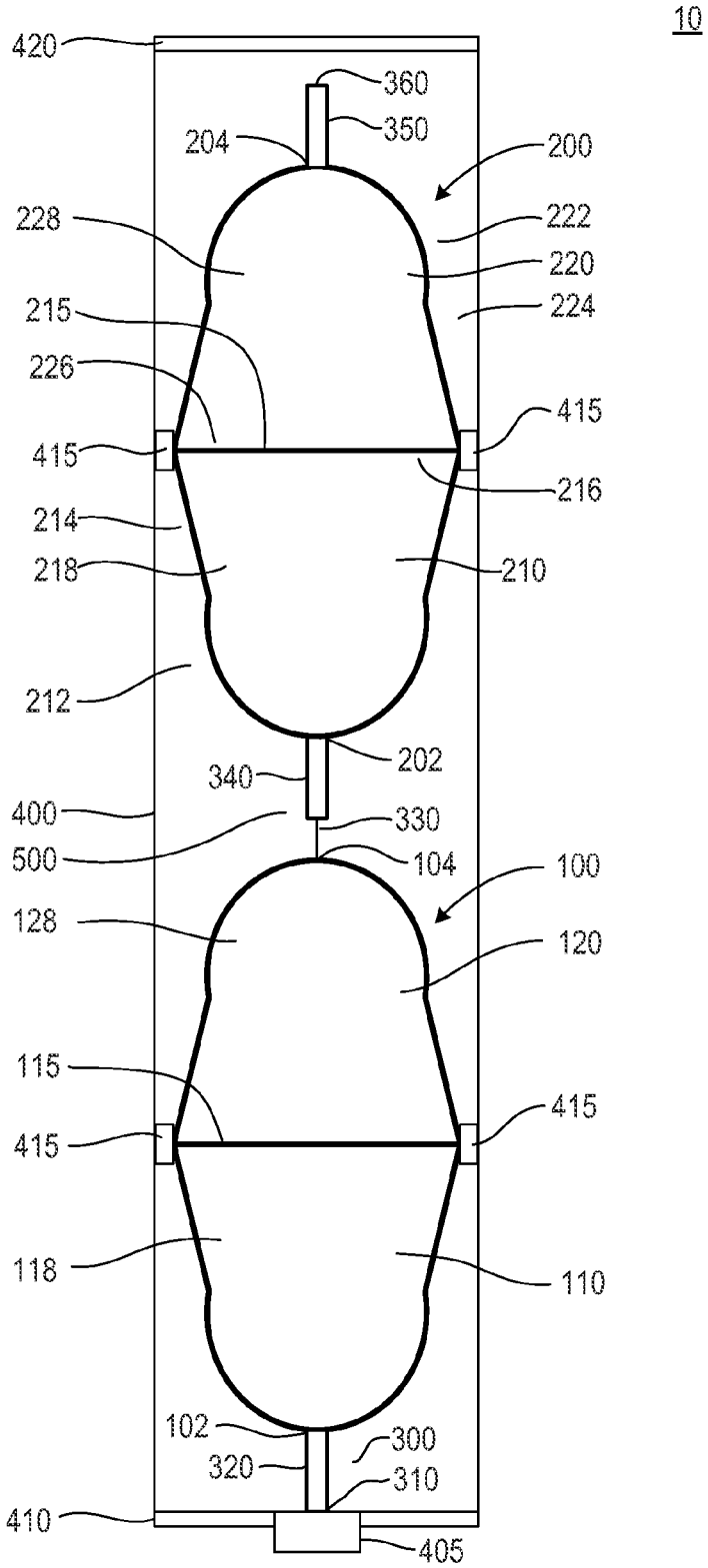
FIG. 3 is a schematic diagram illustrating an antenna including first and second antenna assemblies, according to a representative embodiment.

FIG. 3 is a schematic diagram illustrating an antenna including first and second antenna assemblies, according to a representative embodiment. Antenna 10 as shown in FIG. 3 is configured as having assembly 100 as described with respect to FIG. 2, and another assembly 200 that is of similar construction as assembly 100. That is, assemblies 100 and 200 are disposed separate from each other, with gap 500 there between. Assembly 200 as shown in FIG. 3 is configured as having assembly section 220 electrically connected to assembly section 210.

Assembly section 210 may be characterized as generally helmet-shaped, configured as having an exterior surface 218 including a substantially hemispherical shaped geometry 212 on a truncated cone geometry 214. Assembly section 210 is hollow as including exterior surface 218 that is a conductive material such as copper. At the bottom end of assembly section 210, hole 202 is formed through exterior surface 218 of hemispherical shaped geometry 212, providing access to the hollow interior of assembly section 210. Truncated cone geometry 214 further includes open end 216. Assembly section 220 may also be characterized as generally helmet-shaped, configured as having an exterior surface 228 including a substantially hemispherical shaped geometry 222 on a truncated cone geometry 224. Assembly section 220 is hollow as including exterior surface 228 that is a conductive material such as copper. At the top end of assembly section 220, hole 204 is formed through exterior surface 228 of hemispherical shaped geometry 222, providing access to the hollow interior of assembly section 220. Truncated cone geometry 224 further includes open end 226. Assembly section 210 and assembly section 220 may be soldered to each other at respective open ends 216 and 226 of the truncated cone geometries and electrically connected at seam 215, to provide a joint having a smooth surface without abrupt transition at seam 215.

As shown in FIG. 3, assemblies 100 and 200 may be disposed along a vertical direction within tube 400, with assembly 100 (first assembly) located near the bottom of tube 400 and assembly 200 (second assembly) above assembly 100. Tube 400 may be made of plastic to provide mechanical strength and protection from the environment, and may have a thickness of about ⅛ inch suitable for antenna frequencies up to about 6 GHz. Tube 400 as configured may include a plastic cap or plug 420 that closes off the top of tube 400, and a bulkhead 410 that closes off the bottom of tube 400. Bulkhead 410 may be plastic, hard rubber or metal for example. A connector 405 may be provided integral with bulkhead 410. Cable (conductor) 300 may be electrically connected to connector 405, and disposed to extend within tube 400 through assemblies 100 and 200, and out assembly 200 at the top of tube 400 near cap 420. In a representative embodiment, cable 300 may be a coaxial cable having an inner conductor and an outer conductor. Cable 300 may be a semi-rigid coaxial cable. Blocks 415 may be adhered to the inner sides of tube 400 between assemblies 100 and 200, to ensure that assemblies 100 and 200 rest snuggly against the interior surface of tube 400. Blocks 415 may be foam with adhesive on either or both sides thereof, or may be foam tape. Bulkhead 410 is mounted to a surface so that an axis of tube 400 extends vertically, and so that antenna 10 may function as an omni-directional vertically polarized antenna.

The interconnections between cable 300 and assemblies 100 and 200 of antenna 10 will now be described in greater detail with reference to FIG. 3. In this representative embodiment, cable 300 is a coaxial cable having an inner conductor and an outer conductor, and may hereinafter be referred to interchangeably as coaxial cable or cable 300.

As shown in FIG. 3, a portion 320 of coaxial cable 300 includes a first end 310 electrically connected to connector 405 at bulkhead 410, and a second end that extends into assembly section 110 of assembly 100 through hole 102. At hole 102, a small portion of the outer insulator of coaxial cable 300 is removed, and the outer conductor of coaxial cable 300 is electrically connected to exterior surface 118 of assembly section 110. In a representative embodiment, the outer conductor of coaxial cable 300 may be soldered to assembly section 110 at hole 102. In another representative embodiment, the outer conductor of coaxial cable 300 may be electrically connected to assembly section 110 using a metal clip or wire mesh. The inner conductor of coaxial cable 300 is not electrically connected to assembly section 110. Coaxial cable 300 including both the inner and outer conductor with the outer insulation intact extends from hole 102 inside assembly sections 110 and 120 of assembly 100, and out through hole 104 at assembly section 120. At hole 104, a small portion of the outer insulator of coaxial cable 300 is removed, and the outer conductor of coaxial cable 300 is electrically connected to exterior surface 128 of assembly section 120, by either solder or clip. The inner conductor of coaxial cable 300 is not electrically connected to assembly section 120.

As further shown in FIG. 3, coaxial cable 300 emerging from hole 104 of assembly 100 includes portions 330 and 340 in the gap 500 between assemblies 100 and 200. At portion 330, the outer conductor is removed from coaxial cable 300, and the insulation is removed, from the inner conductor, so that only the exposed inner conductor is present at portion 330. At portion 340, both the inner and outer conductors and the outer insulation of coaxial cable 300 remain intact. At hole 202 of assembly section 210 of assembly 200, the inner and outer conductors of coaxial cable 300 are electrically connected together and to exterior surface 218 of assembly section 210. In a representative embodiment, the electrical connection at hole 202 may be by a metal clip or wire mesh. In another representative embodiment, the electrical connection at hole 202 may be by solder. In order to electrically connect the inner and outer conductors together to exterior surface 218 of assembly section 210 by solder, the outer insulation of coaxial cable 300, the outer conductor and the insulation from the inner conductor may be removed at hole 202. Bare wire (28 gauge or finer) may then be wound on the exposed inner conductor and built up so that it reaches the same level as the outer conductor. The inner conductor and the outer conductor of coaxial cable 300 are then soldered together to exterior surface 218 of assembly section 210 at hole 202, with the wound fine gauge wire assisting solder wetting between the inner and outer conductors. Of note, despite the use of a hollow plastic form to construct assembly section 210 as described previously, exterior surface 218 which may be plated copper, disperses the heat from soldering away from a local plastic zone immediately beneath the soldered area, thus preventing melting, softening and/or deformation of the plastic form.

Coaxial cable 300 including both the inner and outer conductor with the outer insulation intact extends from hole 202 inside assembly sections 210 and 220 of assembly 200, and out through hole 204 of assembly section 220. At hole 204 of assembly section 220, the inner and outer conductors of coaxial cable 300 are electrically connected together and to exterior surface 228 of assembly section 220 by either solder, a metal clip or wire mesh. As further shown in FIG. 3, coaxial cable 300 emerging from hole 204 of assembly 200 includes portion 350, where both the inner and outer conductors and the outer insulation of coaxial cable 300 remain intact. The inner and outer conductors of coaxial cable 300 are shorted together outside assembly section 220 at terminal end 360 of coaxial cable 300.

Figure 4:
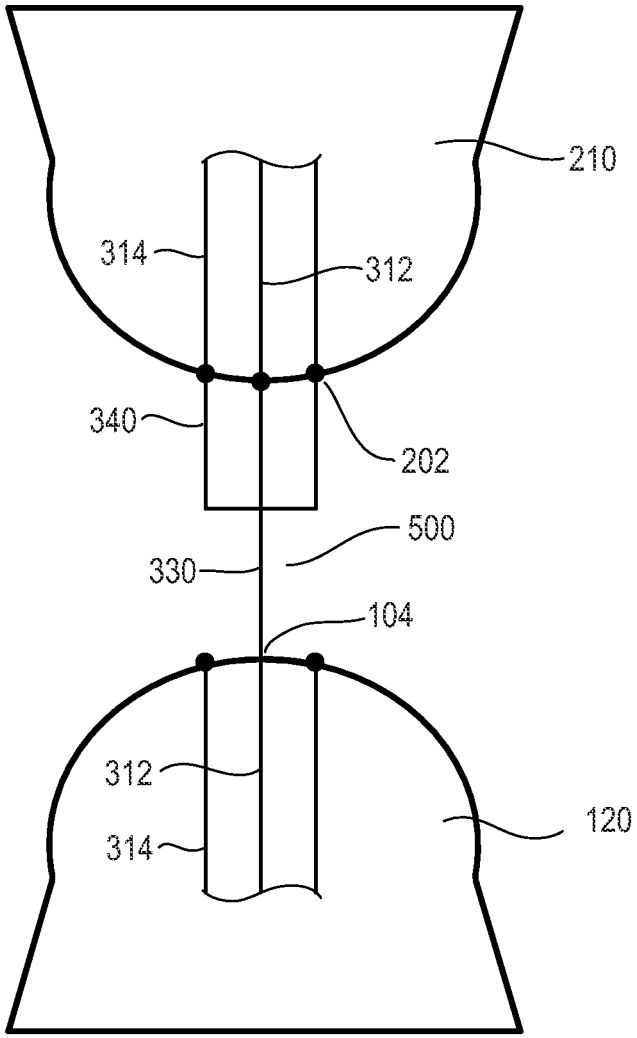
FIG. 4 is a schematic diagram further illustrating a part of the antenna of FIG. 3, according to a representative embodiment.

FIG. 4 is a schematic diagram further illustrating apart of the antenna of FIG. 3, according to a representative embodiment. In FIG. 4, for purposes of explanation, assembly sections 120 and 210 are shown as including portions 330 and 340 of the coaxial cable in the gap 500 between assemblies 100 and 200 (see FIG. 3). The coaxial cable within assembly section 120 is shown as including inner conductor 312 and outer conductor 314. Outer conductor 314 is shown schematically as electrically connected to assembly section 120 at hole 104. At portion 330 of the coaxial cable extending out of assembly section 120 through hole 104, outer conductor 314 and the insulation from the inner conductor 312 are removed, so that only exposed inner conductor 312 is present at portion 330. At portion 340, inner conductor 312, outer conductor 314 and the outer insulation of coaxial cable 300 are intact. At hole 202 of assembly section 210, inner conductor 312 and outer conductor 314 are shown schematically as electrically connected to assembly section 210. The coaxial cable including inner conductor 312, outer conductor 314 and the outer insulation intact is shown as extending within assembly section 210.

In operation, assemblies 100 and 200 shown in FIG. 3 lower the first resonant frequency of antenna 10, which functions as a finite-length dipole-like radiator for a given length, thereby extending the impedance bandwidth of antenna 10 to lower frequencies. The low frequency end of the impedance or VSWR spectral usage of antenna 10 is determined by the frequency at which the overall length from connector 405 to terminal end 360 is about one half of the wavelength.

Additionally, assemblies 100 and 200 choke off the current in the distal regions of the poles at high frequencies, thereby extending the doughnut-like far-field pattern behavior to higher frequencies. At high frequencies, a simple dipole is found to be resonant at higher harmonic numbers, meaning that the current distribution along the dipole consists of multiple half wavelength cycles at the frequencies where efficient radiation occurs. However, an undesirable consequence of this is that the far field elevation pattern becomes multi-lobed. For some broadband (less resonant) antenna designs such as discones, this effect is not pronounced at low harmonic numbers, but the multi-lobed elevation pattern is pronounced at the high frequency end of the VSWR bandwidth. Antenna 10 as shown in FIG. 3 mitigates the tendency toward elevation angle multi-lobing at high frequencies by the presence of hemispherical shaped geometry 122 of assembly 100 (FIG. 2) and hemispherical shaped geometry 212 of assembly 200, in particular the two hemispherical shaped geometries near gap 500. The structure of antenna 10 in the vicinity of gap 500 as shown in FIG. 4 thus resembles a dual (left-right) Vivaldi antenna structure. The Vivaldi antenna, a flared version of a vee antenna, is a broadband planar antenna with horn-like radiation behavior, i.e., the far field pattern is characterized by high directivity in the ray direction at which the flare opens. That is, current that propagates along coaxial cable 300 responsive to a signal input at connector 405 is coupled to the exterior surfaces 128 and 218 of respective assembly sections 120 and 210 by way of the previously described solder, metal clip or wire mesh connections. At high frequencies, most of the radiated power of antenna 10 actually detaches as the radiating currents die off from the exterior surfaces 128 and 218 of respective assembly sections 120 and 210, before the outgoing wavefront reaches open ends 126 and 216. Hemispherical shaped geometry 122 of assembly 100 and hemispherical shaped geometry 212 of assembly 200 serve as field spreaders that function to spread the radiating currents so that they may die off. Of note, antenna 10 actually has Vivaldi-like cross sections revolved 360° around the vertical axis of coaxial cable 300. Consequently, the far field pattern of antenna 10 maintains azimuthal symmetry (omni-directionality), but to first order with a concentration along the horizon even at the highest frequencies of the VSWR bandwidth. An elevation plane of the far field pattern is substantially free of nulls that are less than −10 dB in zenith and anti-zenith directions.

Assemblies 100 and 200 of antenna 10 further include conical bulges at respective seams 115 and 215 as shown in FIG. 3, which improve the radiation pattern at intermediate frequencies, thus increasing the horizon gain. An intuitive understanding of how antenna 10 works at intermediate frequencies is frustrated by the fact that the current distribution neither resembles the half sine wave of a resonant simple dipole as at low frequencies, nor a revolved Vivaldi antenna current distribution as at high frequencies. Rather, the current distribution at intermediate frequencies takes on characteristics of both low and high frequency distributions, and the mixture depends on the precise frequency and the shape of assemblies 100 and 200.

Electromagnetic simulation and empirical experimentation reveal that introducing a bulge in the mid-section of assemblies 100 and 200 at respective seams 115 and 215 remediates the intermediate frequency horizon gain suppression. The simplest geometric realization of the bulge is the introduction of truncated cone geometries 114 and 124 in assembly sections 110 and 120 at seam 115 of assembly 100 as shown in FIG. 2 for example, where the diameter of assembly 100 is greatest. However, there is a tradeoff in that a larger bulge generally produces a better elevation pattern, but also increases the antenna volume and consequent wind load.

As an example, in accordance with the above noted representative embodiments, a 350-6000 MHz omni-directional antenna was constructed with very smooth elevation pattern at 6000 MHz (6 GHz). The antenna had an impedance and an azimuthally omni-directional far field pattern that were ultra-broadband. The height of the antenna (including the connector) was 19 inches, and back-to-back truncated cones geometries were used for each assembly, so that the circular diameter of the support tube was 3.75 inches. Simulation revealed that the horizon gain suppression was reduced, to 6 dB or less in this example.

Of note, vertical length of gap 500 between assemblies 100 and 200 of antenna 10 shown in FIG. 3 should be as short as possible so as to extend high frequency operation of antenna 10. In a representative embodiment, the length of gap 500 between assemblies 100 and 200 may be about ⅛ inch or less. In a further representative embodiment, the length of gap 500 between assemblies 100 and 200 may be about 1/16 inch or less. For example, antenna 10 configured with gap 500 having length about ⅛ inch would operate at frequencies up to about 6 GHz. Antenna 10 configured with gap 500 having length about 1/16 inch would operate at frequencies up to about 12 GHz. Also, in a representative embodiment, the vertical length of assemblies 100 and 200 may be about ⅓ the overall vertical length of antenna 10. The overall vertical length of antenna 10 may be about ½λ at the lowest frequency of operation. As an example, the length of assemblies 100 and 200 may be in a range of about 2.5 inches to 8 inches, and the length of antenna 10 may be in a range of about 6 inches to 30 inches. It should however be understood that the dimensions noted above and mentioned through this disclosure are given merely as examples, and should not be construed as limiting. That is, the dimensions may be varied within the scope of this disclosure to meet desired applications.

It should be understood that the narrow diameter of antenna 10 including tube 400 is attractive for both indoor and outdoor geolocation deployment. Indoors, antenna 10 may be inserted in the interstices between the wails of adjacent rooms. Such covert monitoring is highly desired by many customers. Outdoors, antenna 10 would be subject to low wind loading due to its narrow diameter. Of note, since all antennas including dipoles have nontrivial far field patterns, shaking and/or vibration of an antenna in windy conditions may dither the far field gain vs. elevation angle. With increased wind load, the elevation plane pattern becomes more complicated, and dithering consequently increases. Conventional antennas are often mounted on a stiffer mast in an effort to alleviate dithering, but the use of such stiffer masts increases antenna weight and cost, and results in a much more obtrusive sensor station.

Figure 5:
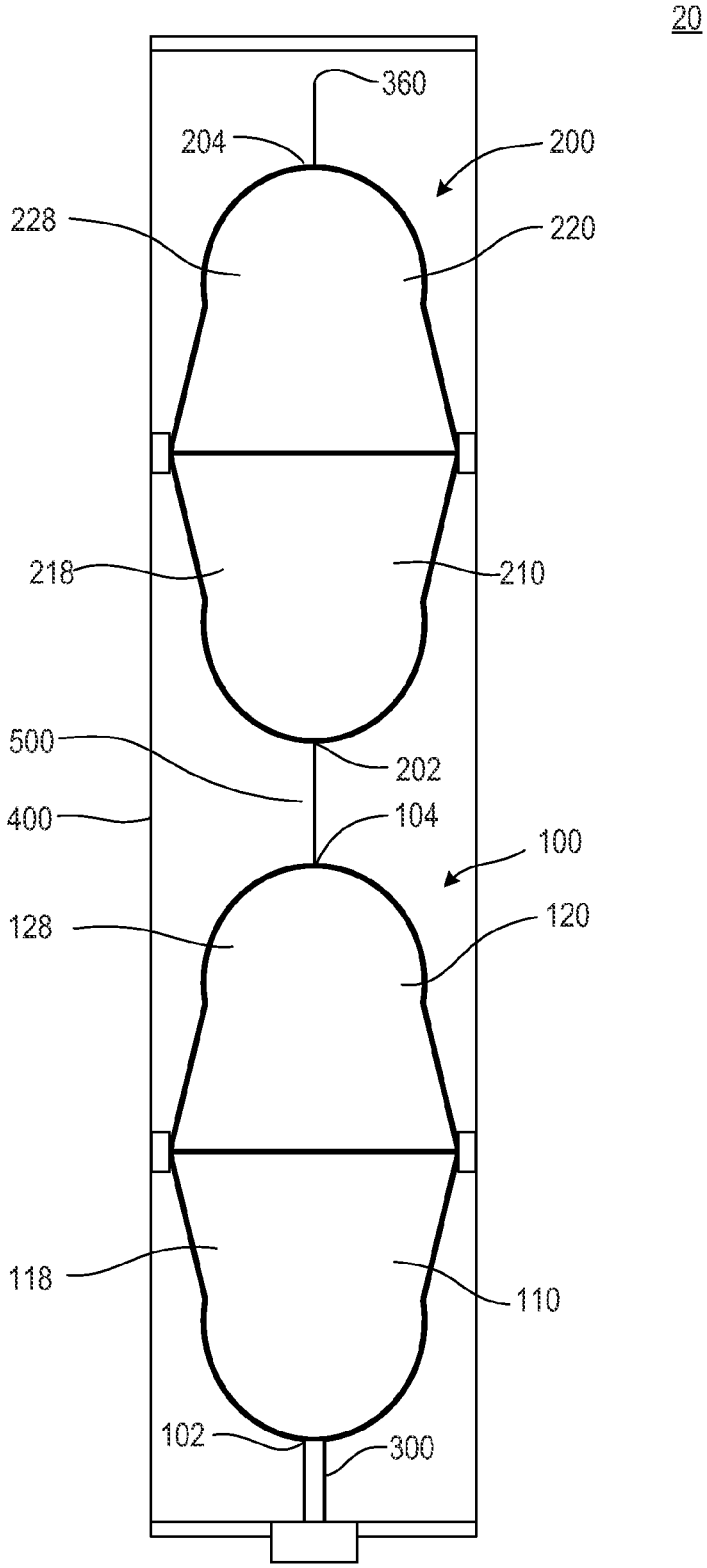
FIG. 5 is a schematic diagram illustrating an antenna, according to another representative embodiment.
Figure 6:
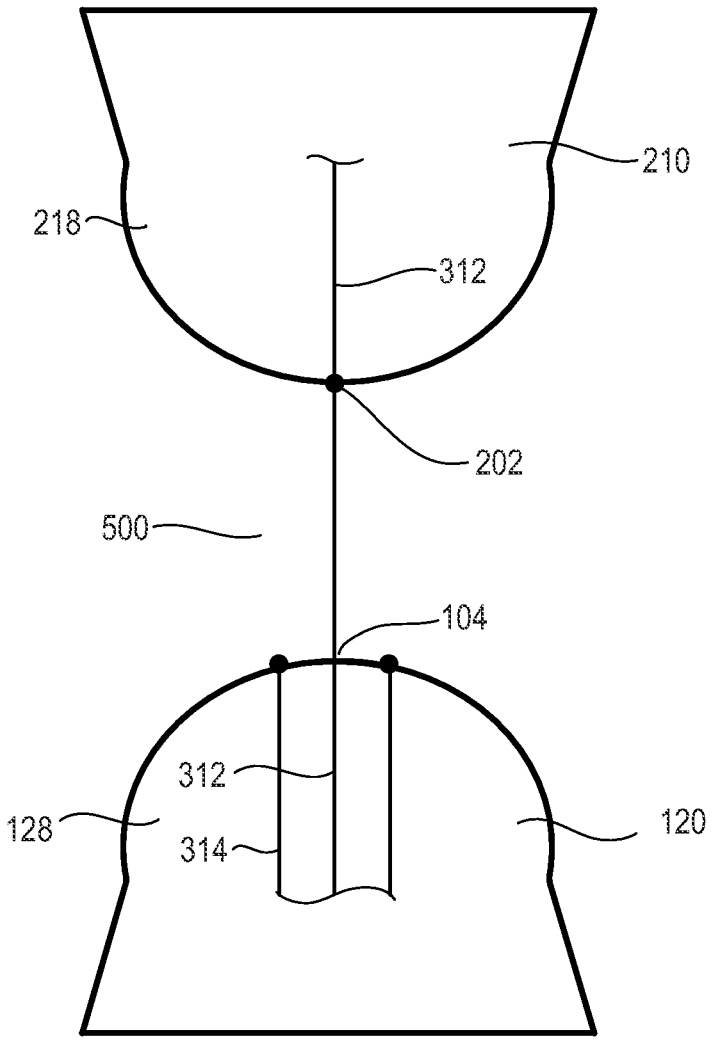
FIG. 6 is a schematic diagram further illustrating a part of the antenna of FIG. 5, according to a representative embodiment.

FIG. 5 is a schematic diagram illustrating an antenna, according to another representative embodiment. Antenna 20 shown in FIG. 5 may include similar features as antenna 10 shown in FIG. 3, including somewhat similar reference numerals. Description of such similar features may be omitted from the following. FIG. 6 is a schematic diagram further illustrating a part of the antenna of FIG. 5, according to a representative embodiment. In order to simplify explanation, only assembly sections 120 and 210 of respective assemblies 100 and 200 are shown in FIG. 6. Antenna 20 is thus described with reference to FIGS. 5 and 6 as follows.

As shown in FIG. 5, assembly 100 including assembly sections 110 and 120, and assembly 200 including assembly sections 210 and 220, may be disposed along a vertical direction within tube 400, with assembly 100 located near the bottom of tube 400 and assembly 200 above assembly 100. Coaxial cable 300 extends into assembly section 110 of assembly 100 through hole 102, and the outer conductor of coaxial cable 300 is electrically connected to exterior surface 118 of assembly section 110 by solder, a metal clip or wire mesh. The inner conductor of coaxial cable 300 is not electrically connected to assembly section 110. Coaxial cable 300 including both the inner and outer conductors with the outer insulation intact extends from hole 102 inside assembly sections 110 and 120 of assembly 100, and out through hole 104 at assembly section 120. At hole 104, the outer conductor of coaxial cable 300 is electrically connected to exterior surface 128 of assembly section 120, by either solder, a metal clip or wire mesh. This is shown in greater detail in FIG. 6, wherein outer conductor 314 is electrically connected to exterior surface 128, and inner conductor 312 extends from hole 104 into gap 500 between assembly sections 120 and 210 without electrical connection to exterior surface 128 of assembly section 120. Thus, the configuration of antenna 20 up to and including assembly 100 in FIG. 5 is the same as the corresponding configuration of antenna 10 described with respect to FIG. 3.

As further shown in FIGS. 5 and 6, outer conductor 314 and the insulation from inner conductor 312 are removed from coaxial cable 300 emerging from hole 104 of assembly section 120, so that only exposed inner conductor 312 is present in gap 500 between assembly sections 120 and 210. At hole 202 of assembly section 210, inner conductor 312 is electrically connected to exterior surface 218 of assembly section 210. Exposed inner conductor 312 extends within both assembly sections 210 and 220 of assembly 200 shown in FIG. 5, and is electrically connected to exterior surface 228 of assembly section 220 at hole 204, by either solder, a metal clip or wire mesh. Exposed inner conductor 312 emerges from hole 204 of assembly section 220 of assembly 200, and is terminated at terminal end 360 within tube 400.

Accordingly, antenna 20 as shown in the representative embodiment of FIGS. 5 and 6 is configured so that only exposed inner conductor 312 of coaxial cable 300 emerges from and extends beyond assembly section 120 of assembly 100. That is, exposed inner conductor 312 of coaxial cable 300 emerges from hole 104 of assembly section 120 and into gap 500, extends through assembly 200, and is terminated at terminal end 360. Antenna 20 is an omni-directional antenna with very smooth elevation pattern, similar to antenna 10 described with respect to FIG. 3. In accordance with the representative embodiments as described with respect to FIGS. 5 and 6, techniques for stripping the outer conductor and insulation from the inner conductor in the direction of terminal end 360 may be easier and quicker than techniques for making incision cuts as previously described.

Figure 7:
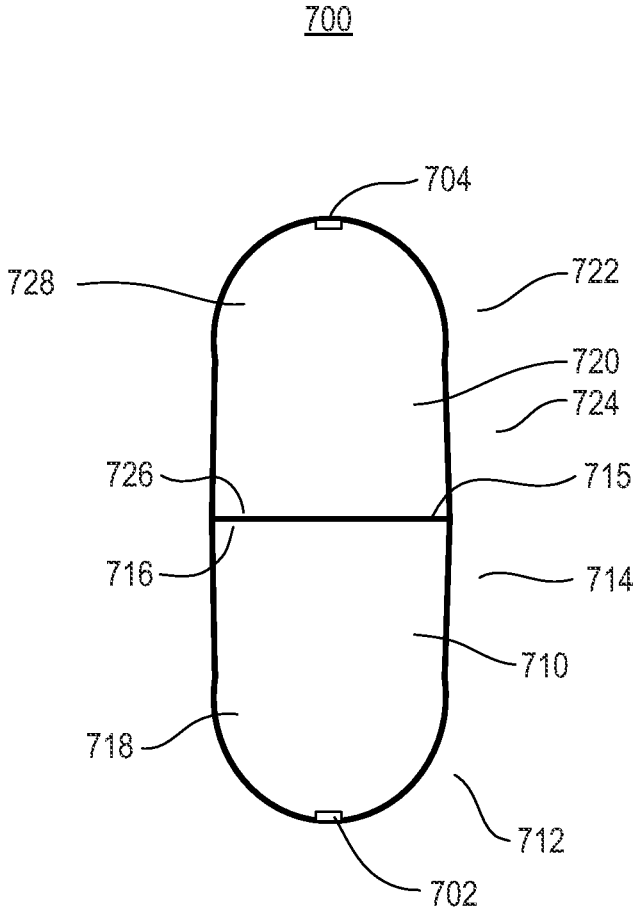
FIG. 7 is a schematic diagram illustrating an antenna assembly including a pair of assembly sections, according to a representative embodiment.

FIG. 7 is a schematic diagram illustrating an antenna assembly including a pair of assembly sections, according to a representative embodiment. Assembly 700 as shown in FIG. 7 is configured, as having assembly section 720 electrically connected to assembly section 710. Assembly section 710 shown in FIG. 7 may be configured as having an exterior surface 718 including a substantially hemispherical shaped geometry 712 on a cylindrical shaped geometry (section) 714. At the bottom end of assembly section 710, hole 702 is formed through exterior surface 718 of hemispherical shaped geometry 712, providing access to the hollow interior of assembly section 710. Cylindrical shaped geometry 714 includes open end 716. Assembly section 720 may be configured as having an exterior surface 728 including a substantially hemispherical shaped geometry 722 on a cylindrical shaped geometry (section) 724. At the top end of assembly section 720, hole 704 is formed through exterior surface 728 of hemispherical shaped geometry 722, providing access to the hollow interior of assembly section 720. Cylindrical shaped, geometry 724 includes open end 726. Assembly section 710 and assembly section 720 may be soldered to each other at respective open ends 716 and 726 of the cylindrical shaped geometries and electrically connected at seam 715, to provide a joint having a smooth surface without abrupt transition at seam 715.

Assembly 700 as shown in FIG. 7 thus has cylindrical shaped sections 714 and 724 between respective hemispherical shaped geometries 712 and 722. That is, the mid-section of assembly 700 between respective hemispherical shaped geometries 712 and 722 has substantially uniform diameter, without a bulge at seam 715. The diameter of an antenna such as shown in FIG. 3 including assemblies 700 without a bulge replacing assemblies 100 and 200, and including tube 400, may be about 3 inches. A horizon gain suppression of such an antenna including assemblies 700 was found, to be 10 dB at 2 GHz both in simulation and in anechoic measurement. However, at one or two intermediate frequencies, the horizon gain of such an antenna including assemblies 700 may actually be suppressed rather than enhanced. This suppression of the horizon gain may limit detection range when deploying a small number of geolocation sensors outdoors. In accordance with the representative embodiment described with respect to FIG. 7, a compact, ultra-broadband antenna with low wind loading may be provided.

In the representative embodiments, exterior surfaces 118, 128, 218 and 228 of respective assembly sections 110, 120, 210 and 220 which may be copper for instance, are described, as having a thickness in a range of about 5 microns to 100 microns. It should be understood generally that an antenna in accordance with the representative embodiments would be lighter and less expensive if made with thinner exterior surfaces. Also, the diameter of holes 102, 104, 202 and 204 are described as in a range of about 2 mm to 4 mm. In general, the diameter of the holes may be determined by the diameter of cable 300.

While specific embodiments are disclosed herein, many variations are possible, which remain within the concept and scope of the present teachings. For example, if tube 400 may is made of transparent plastic such as acrylic or polycarbonate, a scroll of thin non-transparent plastic, garden tarp or other material may be inserted, along the inner wall of tube 400 to hide the interior configuration of the antenna. Alternatively, in the case that tube 400 is thin-walled, opaque pipe made of PVC, ABS or smoked, acrylic for example, a scroll would not be necessary. Also, in the case that tube 400 is transparent acrylic or polycarbonate material, the material may be painted opaque. Such variations would be apparent in view of the specification, drawings and claims herein.

What is claimed is:

1. An antenna comprising:

a first assembly having first and second ends;

a second assembly having first and second ends, the first and second ends of both of the first and second assemblies having a substantially hemispherical shape; and a cable configured to extend through the first and second assemblies.

2. The antenna of claim 1, wherein the cable is comprised of inner and outer conductors.

3. The antenna of claim 2, wherein only the outer conductor is electrically connected to the first assembly.

4. The antenna of claim 3, wherein both the inner and outer conductors are electrically connected to the second assembly.

5. The antenna of claim 3, wherein only the inner conductor is electrically connected to the second assembly.

6. The antenna of claim 2, wherein the first and second assemblies are disposed separate from each other, the cable extends in a gap between the first and second assemblies, and the outer conductor is removed from a portion of the cable in the gap.

7. The antenna of claim 6, wherein the inner conductor is exposed at the portion of the cable where the outer conductor is removed.

8. The antenna of claim 2, wherein the first and second assemblies are disposed separate from each other with a gap in between, and the outer conductor is removed from the cable in the gap and from the cable extending through and out of the second assembly.

9. The antenna of claim 2, wherein the inner and outer conductors are shorted together at a terminal end outside the second assembly.

10. The antenna of claim 1, wherein the cable extends out each of the first and second ends.

11. The antenna of claim 1, wherein exterior surfaces of the first and second assemblies are conductive.

12. The antenna of claim 1, wherein the first and second assemblies of both of the first and second assemblies each comprise a mid-section between the respective first and second ends of the first and second assemblies, wherein a diameter of each of the mid-sections is greater than a diameter at the respective first and second ends of the first and second assemblies.

13. The antenna of claim 1, wherein the first and second assemblies of both of the first and second assemblies each comprise a mid-section between the respective first and second ends of the first and second assemblies, wherein each of the mid-sections have a substantially uniform diameter between the first and second ends.

14. The antenna of claim 1, having an impedance and an azimuthally omni-directional far field pattern that are ultra-broadband.

15. The antenna of claim 14, wherein an elevation plane of the far field pattern is substantially free of nulls that are less than −10 dB in zenith and anti-zenith directions.

16. The antenna of claim 1, wherein the first assembly comprises a first assembly section and a second assembly section, the first assembly section of the first assembly being electrically connected to the second assembly section of the first assembly at a seam, the antenna comprising a conical bulge in the first assembly section of the first assembly at the seam.

17. The antenna of claim 16, wherein the conical bulge is a first conical bulge, and the second assembly section of the first assembly comprises a second conical bulge at the seam.

18. The antenna of claim 1, wherein the second assembly comprises a first assembly section and a second assembly section, the first assembly section of the second assembly being electrically connected to the second assembly section of the second assembly at a seam, the antenna comprising a conical bulge in the first assembly section of the second assembly at the seam.

19. The antenna of claim 18, wherein the conical bulge is a first conical bulge, and the second assembly section of the second assembly comprises a second conical bulge at the seam.

* * * * *